US008126706B2

(12) United States Patent
Ebenezer

(10) Patent No.: US 8,126,706 B2
(45) Date of Patent: Feb. 28, 2012

(54) MUSIC DETECTOR FOR ECHO CANCELLATION AND NOISE REDUCTION

(75) Inventor: Samuel Ponvarma Ebenezer, Tempe, AZ (US)

(73) Assignee: Acoustic Technologies, Inc., Mesa, AZ (US)

( * ) Notice: Subject to any disclaimer, the term of this patent is extended or adjusted under 35 U.S.C. 154(b) by 1704 days.

(21) Appl. No.: 11/298,865

(22) Filed: Dec. 9, 2005

(65) Prior Publication Data

US 2007/0136053 A1 Jun. 14, 2007

(51) Int. Cl.
*G10L 11/06* (2006.01)

(52) U.S. Cl. ..... 704/208

(58) Field of Classification Search ..... 704/208
See application file for complete search history.

(56) References Cited

U.S. PATENT DOCUMENTS

| | | | | |
|---|---|---|---|---|
| 5,394,473 | A | 2/1995 | Davidson | 381/36 |
| 5,583,961 | A | 12/1996 | Pawlewski et al. | 395/2.5 |
| 5,664,052 | A | 9/1997 | Nishiguchi et al. | 704/214 |
| 5,684,921 | A | 11/1997 | Bayya et al. | 395/2.35 |
| 6,477,489 | B1 | 11/2002 | Lockwood et al. | 704/200.1 |
| 6,556,682 | B1 * | 4/2003 | Gilloire et al. | 381/66 |
| 6,658,380 | B1 | 12/2003 | Lockwood et al. | 704/215 |
| 7,317,958 | B1 * | 1/2008 | Freed et al. | 700/94 |
| 7,379,875 | B2 * | 5/2008 | Burges et al. | 704/273 |
| 7,555,117 | B2 * | 6/2009 | Suppappola et al. | 379/406.08 |
| 8,032,387 | B2 * | 10/2011 | Davidson et al. | 704/501 |
| 2004/0086109 | A1 * | 5/2004 | Takada | 379/406.08 |
| 2004/0138886 | A1 * | 7/2004 | Absar et al. | 704/240 |
| 2004/0267522 | A1 * | 12/2004 | Allamanche et al. | 704/205 |
| 2005/0108004 | A1 * | 5/2005 | Otani et al. | 704/205 |
| 2005/0165587 | A1 * | 7/2005 | Cheng et al. | 702/189 |
| 2006/0064299 | A1 * | 3/2006 | Uhle et al. | 704/212 |
| 2006/0074649 | A1 * | 4/2006 | Pachet et al. | 704/229 |
| 2006/0149532 | A1 * | 7/2006 | Boillot et al. | 704/203 |
| 2006/0229878 | A1 * | 10/2006 | Scheirer | 704/273 |
| 2007/0016414 | A1 * | 1/2007 | Mehrotra et al. | 704/230 |
| 2009/0192806 | A1 * | 7/2009 | Truman et al. | 704/500 |

OTHER PUBLICATIONS

Frantz et al., *Comparing Fixed- and Floating-Point DSPs*, Texas Instruments application note SPRY061, © 2004.

* cited by examiner

*Primary Examiner* — Jakieda Jackson
(74) *Attorney, Agent, or Firm* — Paul F. Wille

(57) ABSTRACT

An audio signal is divided among exponentially related subband filters. The spectral flatness measure in each subband signal is determined and the measures are weighted and combined. The sum is compared with a threshold to determine the presence of music or noise. If music is detected, the noise estimation process in the noise reduction circuitry is turned off to avoid distorting the signal. If music is detected, residual echo suppression circuitry is also turned off to avoid inserting comfort noise.

8 Claims, 7 Drawing Sheets

```
Task 1 Compute the geometric mean to the power N(k)

     GM(k)^N(k) = prod(X[i,k]),
     where,  k is the sub-band number
             i is the bin number
             N(k) is the number of bins in a sub-band
The geometric mean is computed based on floating point
operation.
Step 1
     Compute the norm factor for X[i,k] and X[i+1,k]
Step 2
     Normalize X[i,k] and X[i+1,k] by the their
     corresponding norm factors in step 1.
Step 3
     Multiply the normalized data from Step 2 and add
     their norm factors from step 1.
Step 4:
     Compute the norm factor for X[i+2,k] and the
     result from Step 3 and normalize them with their
     respective norm factors.
Step 5
     Repeat Step 3 with normalized X[i+2,k] and the
     normalized result from Step 4.
Step 6
     Perform Step 4-5 until all the magnitudes are
     multiplied.


The final result will be expressed as a mantissa and
an exponent (power of 2) (i.e) y.2^m.
```

FIG. 9

```
Task 2   Compute the arithmetic mean

    AM(k) = sum(X[i,k])/N(k),
    where,   k is the sub-band number
             i is the bin number
             N(k) is the number of bins in a sub-band

The arithmetic mean is computed based on floating
point operation. The following steps are followed,
Step 1:
    Shift the data x[k] by the number of integer bits
 Step 2
    Add the shifted data with the temporary
    summation result.
Step 3
    Continue Step 1 and 2 until all the data is
    added.
Step 4
    Divide the summation result by the number of
    bins in each band.
    Division can be replaced by multiplication by
    storing the inverse of number of bins per
    band (1/N(k)).
Step 5:
    Convert the arithmetic mean to mantissa and
    exponent format.

The final result will be expressed as a mantissa and
an exponent (power of 2), (i.e) x.2^n
```

FIG. 10

```
Task 3 Compute the spectral flatness measure

    Recall that SFM(k) = GM(k)/AM(k)

    GM(k)  = y^{1/N(k)}*2^{-m/N(k)} , (Refer Task 1)
    AM(k)  = x.2^-n , (Refer Task 2)
    SFM(k) = y^(1/N(k)}.2^{-m/N(k)} / x.2^-n

The Nth root involved in the calculation of geometric
mean (numerator) and the division used to compute the
SFM is avoided by using logarithmic and exponential
functions as shown below,


log2 (SFM) = (1/N(k))log2(y) -m/N(k) + n - log2(x)
           = (N(k)*n-m)/N(k) 4- log2(y)/N(k) - log2(x)
           = (N(k)*n-m)/N(k) + 1.442695{ln(y)/N(k) -
                                                ln(x)}
      SFM  = 2^log2(SFM)
           = 2^integer*2^fraction => log2(SFM)
           = integer + fraction
           = 2^integer*exp{fraction*ln(2)}
           = 2^integer*exp{0.693147*fraction}

           where, y is the mantissa in Task 1
           m is the exponent in Task 1
           x is the mantissa in Task 2
           n is the exponent in Task 2
           ln() is natural logarithm
```

FIG. 11

MUSIC DETECTOR FOR ECHO CANCELLATION AND NOISE REDUCTION

BACKGROUND OF THE INVENTION

This invention relates to a telephone employing circuitry for echo cancellation and noise reduction and, in particular, to such circuitry that includes a music detector.

As used herein, "telephone" is a generic term for a communication device that utilizes, directly or indirectly, a dial tone from a licensed service provider. As such, "telephone" includes desk telephones (see FIG. 1), cordless telephones (see FIG. 2), speakerphones (see FIG. 3), hands-free kits (see FIG. 4), and cellular telephones (see FIG. 5), among others. For the sake of simplicity, the invention is described in the context of telephones but has broader utility; e.g. communication devices that do not utilize a dial tone, such as radio frequency transceivers. Although described in the context of telephones, the invention has broader application in the analysis of audio signals.

While not universally followed, the prior art generally associates noise "suppression" with subtracting a signal from the signal of interest and associates noise "reduction" with attenuation or reduced gain. Noise reduction circuitry is generally part of a non-linear processor.

There are many sources of noise in a telephone system. Some noise is acoustic in origin while other noise is electronic, from the telephone network, for example. As used herein, "noise" refers to any unwanted sound, whether the unwanted sound is periodic, purely random, or somewhere in-between. As such, noise includes background music, voices of people other than the desired speaker, tire noise, wind noise, and so on. As thus broadly defined, noise could include an echo of the speaker's voice. However, echo cancellation is treated separately in a telephone.

There are two kinds of echoes in telephones, an acoustic echo from the path between an earphone or a speaker and a microphone and a line echo generated in the switched network for routing a call between stations. Echo cancellation involves subtracting a simulated echo from an input signal. The simulated echo is created by filtering an output signal with an adaptive filter. The adaptive filter is programmed to represent either the near-end path (speaker to microphone) or the far end path (line out to line in) to create the simulated echo.

Noise is subjective, somewhat like a weed. It depends upon what one wants or does not want. In this description, noise is unwanted sound from the perspective of a person trying to converse on a telephone. For example, in a vehicle, noise includes road noise, music from a radio, background conversation, and the sound from the speaker element in a hands-free kit. The desired signal is usually only the voice of the person speaking.

If there is significant amount of background noise, it is usually desirable to reduce the background noise to improve intelligibility. On the other hand, a person may be at a musical concert and it may be desirable to allow the music to pass through the telephone network unaffected. To satisfy these contradictory conditions, one needs a special algorithm to distinguish between noise and music.

It is known in the art to distinguish music from speech; see, for example, Carey, Michael J. et al., *Comparison of Features for Speech*, Music Discrimination, IEEE publication 0-7803-5041-3/99 © 1999. It is also known to distinguish music, speech, and noise; see, for example, G. Lu & T. Hankinson, "A Technique towards Automatic Audio Classification and Retrieval," 1998 *Fourth Signal International Conference on Signal Processing Proceedings* (ISCP-98), Beijing, China 1998. Spectral flatness measure (SFM) is known in the art; see, for example, U.S. Pat. No. 5,648,921 (Bayya et al.) and U.S. Pat. No. 6,477,489 (Lockwood et al.). As used herein, SFM is defined differently from these two patents, which define SFM differently from each other. The differences are in form, not substance.

One of the main challenges in distinguishing music from noise is that the envelopes of both types of signal are relatively constant. Most known voice activity detectors measure the energy content of the envelope, which means that a voice activity detector will detect music as noise and will cause the noise reduction circuitry to reduce the background music, distorting the signal. It will also cause the non-linear processor to suppress the residual echo, which will then insert the comfort noise after suppressing the residual echo. This insertion of comfort noise can annoy a listener because the music will become intermittent. A similar effect can occur in echo canceling systems.

Music is generally characterized by a finite amount of energy at all times, some music having a relatively constant envelope and some not. Most of the acoustic energy in music is below 8 kHz, although rock and hard rock are almost like white noise. The spectral content of music changes frequently, depending upon the rhythm of the music. Based on these characteristics, certain features are selected and several different algorithms are being investigated in the art for classifying sound. Examples are in the literature identified above.

Possible methods for classifying audio signals include envelope detection, linear prediction analysis, zero crossing detection, Bark band spectral analysis, auto-correlation, silence ratio, tracking spectral peaks, and differential spectrum (changes in spectral content from instant to instant). Silence ratio is really an amplitude comparison. A signal is divided into time segments. A signal having an amplitude less than a threshold is silence. The ratio is the number of silent segments divided by the total number of segments. Speech signals have a higher silence ratio than music. Noise and non-speech are problems, as is picking the correct time interval.

Many of these methods are not robust enough to distinguish different genre of music unambiguously from noise. Some of the methods are not meant to be done in real time because of large computational requirements; e.g. requiring wide data bus, large amounts of storage, or long execution time for analysis. Hence, it is desirable to provide a method that can unambiguously distinguish mainstream music genre with small computational requirements.

In view of the foregoing, it is therefore an object of the invention to provide a method for unambiguously distinguishing mainstream music genre from noise.

Another object of the invention is to provide a method for unambiguously distinguishing mainstream music genre from noise while requiring little computational power.

A further object of the invention is to provide a method for unambiguously distinguishing mainstream music genre from noise in real time.

SUMMARY OF THE INVENTION

The foregoing objects are achieved in this invention in which spectral flatness is used to detect music and to distinguish music from noise. An audio signal is divided among exponentially related subband filters. The spectral flatness measure in each subband signal is determined and the measures are weighted and combined. The sum is compared with a threshold to determine the presence of music or noise. If music is detected, the noise estimation process in the noise reduction circuitry is turned off to avoid distorting the signal. If music is detected, residual echo suppression circuitry is also turned off to avoid inserting comfort noise.

BRIEF DESCRIPTION OF THE DRAWINGS

A more complete understanding of the invention can be obtained by considering the following detailed description in conjunction with the accompanying drawings, in which:

FIG. 9 is pseudo-code for calculating geometric mean according to one aspect of the invention;

FIG. 10 is pseudo-code for calculating arithmetic mean according to one aspect of the invention; and FIG. 11 is pseudo-code for calculating the ratio of the geometric mean to the arithmetic mean according to one aspect of the invention.

Those of skill in the art recognize that, once an analog signal is converted to digital form, all subsequent operations can take place in one or more suitably programmed microprocessors. Reference to "signal," for example, does not necessarily mean a hardware implementation or an analog signal. Data in memory, even a single bit, can be a signal. In other words, a block diagram can be interpreted as hardware, software, e.g. a flow chart or an algorithm, or a mixture of hardware and software. Programming a microprocessor is well within the ability of those of ordinary skill in the art, either individually or in groups.

DETAILED DESCRIPTION OF THE INVENTION

Figure 1:
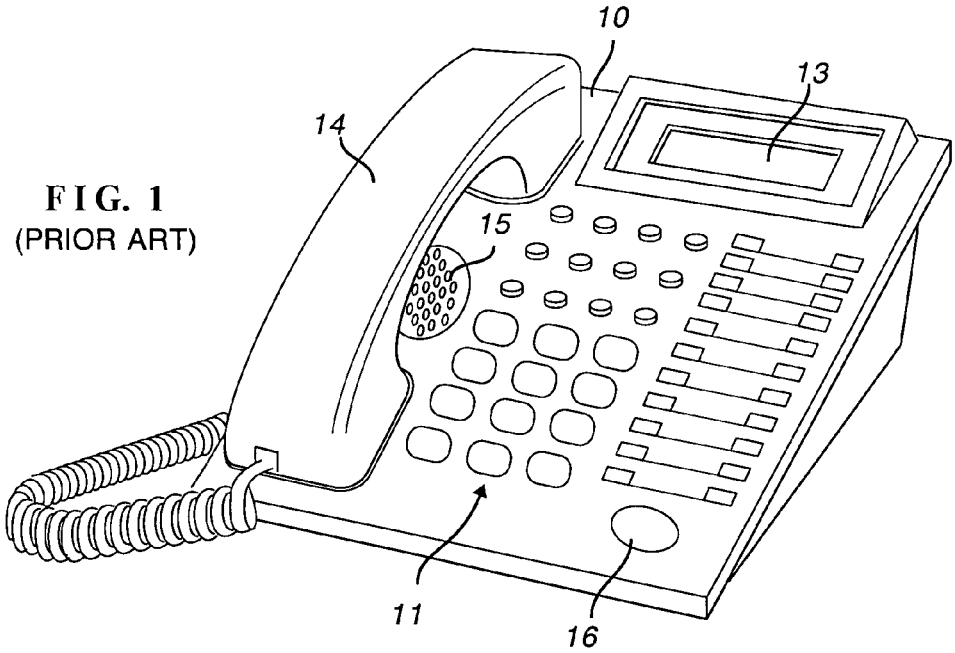
FIG. 1 (PRIOR ART)
FIG. 1 is a perspective view of a desk telephone.
Figure 2:
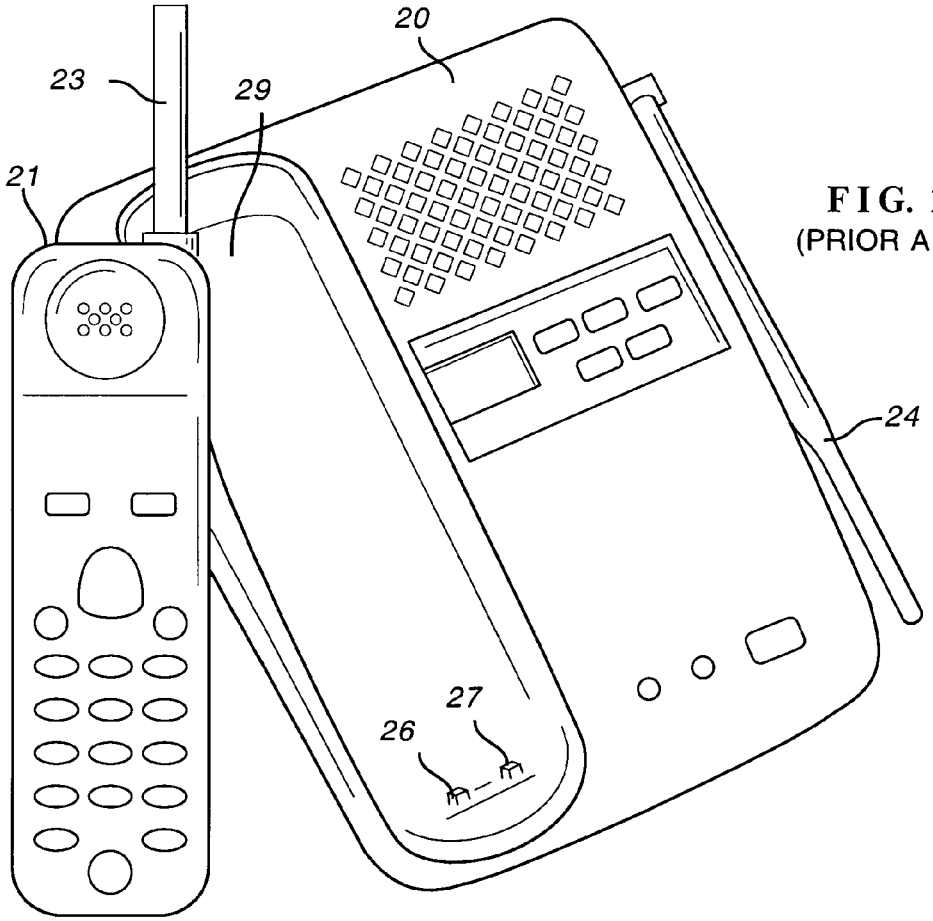
FIG. 2 (PRIOR ART)
FIG. 2 is a perspective view of a cordless telephone.

This invention finds use in many applications where the electronics is essentially the same but the external appearance of the device may vary. FIG. 1 illustrates a desk telephone including base 10, keypad 11, display 13 and handset 14. As illustrated in FIG. 1, the telephone has speakerphone capability including speaker 15 and microphone 16. The cordless telephone illustrated in FIG. 2 is similar except that base 20 and handset 21 are coupled by radio frequency signals, instead of a cord, through antennas 23 and 24. Power for handset 21 is supplied by internal batteries (not shown) charged through terminals 26 and 27 in base 20 when the handset rests in cradle 29.

Figure 3:
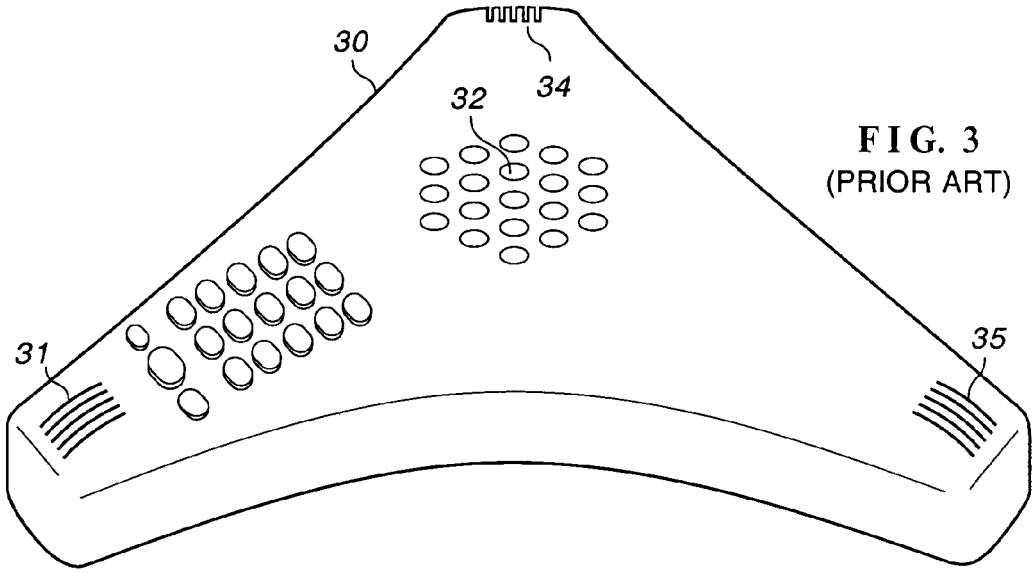
FIG. 3 (PRIOR ART)
FIG. 3 is a perspective view of a conference phone or a speakerphone.

FIG. 3 illustrates a conference phone or speakerphone such as found in business offices. Telephone 30 includes microphone 31 and speaker 32 in a sculptured case. Telephone 30 may include several microphones, such as microphones 34 and 35 to improve voice reception or to provide several inputs for echo rejection or noise rejection, as disclosed in U.S. Pat. No. 5,138,651 (Sudo).

Figure 4:
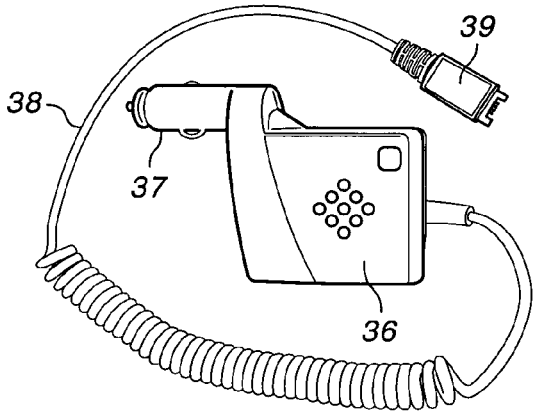
FIG. 4 (PRIOR ART)
FIG. 4 is a perspective view of a hands-free kit.
Figure 5:
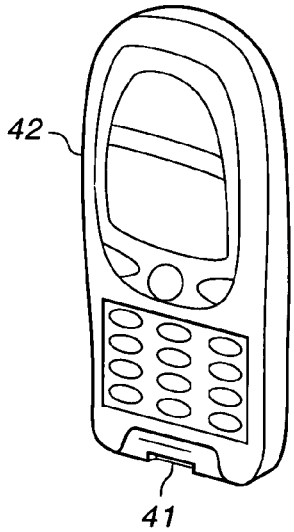
FIG. 5 (PRIOR ART)
FIG. 5 is a perspective view of a cellular telephone.

FIG. 4 illustrates what is known as a hands-free kit for providing audio coupling to a cellular telephone, illustrated in FIG. 5. Hands-free kits come in a variety of implementations but generally include powered speaker 36 attached to plug 37, which fits an accessory outlet or a cigarette lighter socket in a vehicle. A hands-free kit also includes cable 38 terminating in plug 39. Plug 39 fits the headset socket on a cellular telephone, such as socket 41 (FIG. 5) in cellular telephone 42. Some kits use RF signals, like a cordless phone, to couple to a telephone. A hands-free kit also typically includes a volume control and some control switches, e.g. for going "off hook" to answer a call. A hands-free kit also typically includes a visor microphone (not shown) that plugs into the kit. Audio processing circuitry constructed according to the invention can be included in a hands-free kit or in a cellular telephone.

Figure 6:
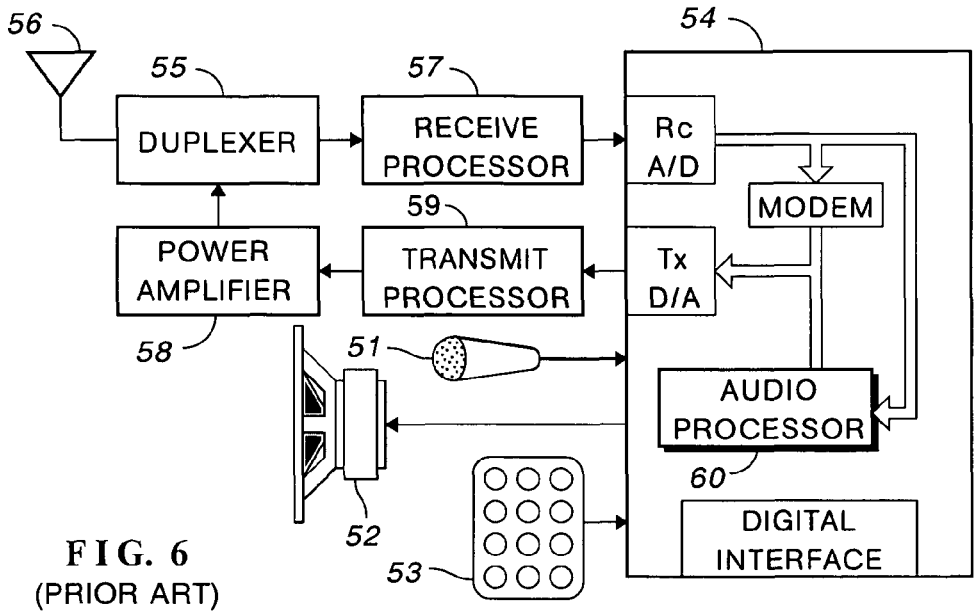
FIG. 6 (PRIOR ART)
FIG. 6 is a generic block diagram of audio processing circuitry in a telephone.

The various forms of telephone can all benefit from the invention. FIG. 6 is a block diagram of the major components of a cellular telephone. Typically, the blocks correspond to integrated circuits implementing the indicated function. Microphone 51, speaker 52, and keypad 53 are coupled to signal processing circuit 54. Circuit 54 performs a plurality of functions and is known by several names in the art, differing by manufacturer. For example, Infineon calls circuit 54 a "single chip baseband IC." QualComm calls circuit 54 a "mobile station modem." The circuits from different manufacturers obviously differ in detail but, in general, the indicated functions are included.

A cellular telephone includes both audio frequency and radio frequency circuits. Duplexer 55 couples antenna 56 to receive processor 57. Duplexer 55 couples antenna 56 to power amplifier 58 and isolates receive processor 57 from the power amplifier during transmission. Transmit processor 59 modulates a radio frequency signal with an audio signal from circuit 54. In non-cellular applications, such as speakerphones, there are no radio frequency circuits and signal processor 54 may be simplified somewhat. Problems of echo cancellation and noise remain and are handled in audio processor 60. It is audio processor 60 that is modified to include the invention. How that modification takes place is more easily understood by considering the echo canceling and noise reduction portions of an audio processor in more detail.

Figure 7:
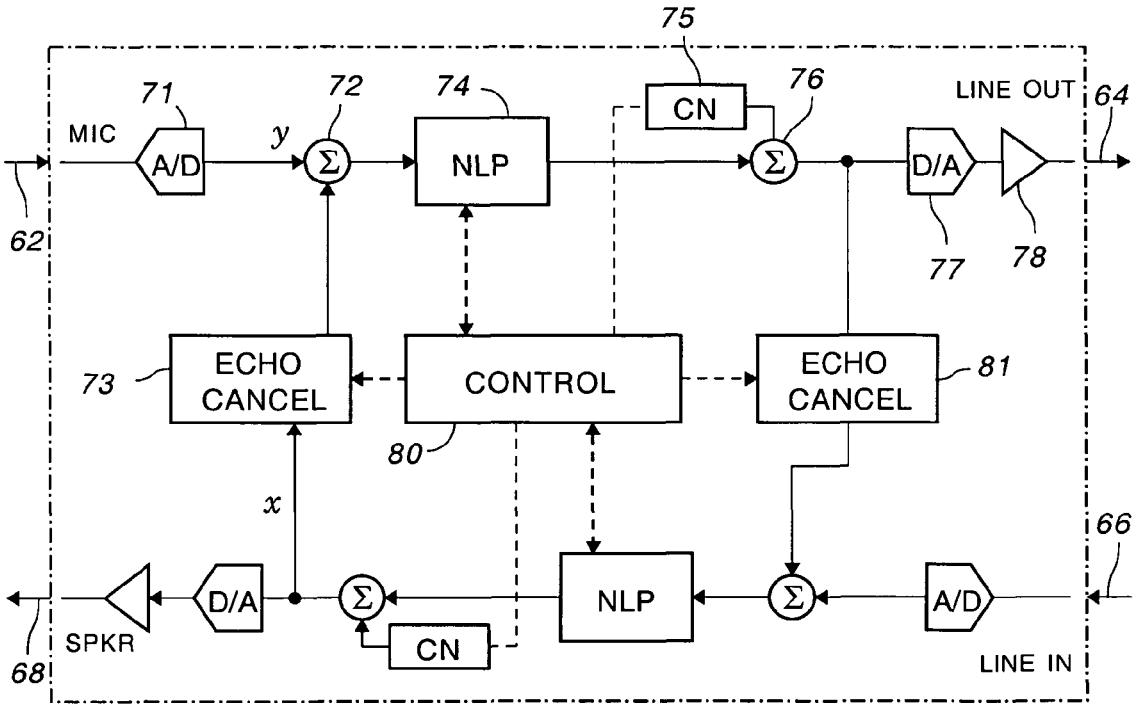
FIG. 7 is a more detailed block diagram of audio processing circuitry in a telephone.

FIG. 7 is a detailed block diagram of a noise reduction and echo canceling circuit; e.g. see chapter 6 of *Digital Signal Processing in Telecommunications* by Shenoi, Prentice-Hall, 1995. The following describes signal flow through the transmit channel, from microphone input 62 to line output 64. The receive channel, from line input 66 to speaker output 68, works in the same way, except that the gain of a particular stage may be different from the gain of a corresponding stage in the transmit channel.

A new voice signal entering microphone input 62 may or may not be accompanied by ambient noise or sounds from speaker output 68. The signals from input 62 are digitized in A/D converter 71 and coupled to summation network 72. There is, as yet, no signal from echo canceling circuit 73 and the data proceeds to non-linear processing circuit 74, which includes a music detector and other circuitry, such as a noise reduction circuit, a residual echo canceling circuit, and a center clipper.

The output from non-linear processing circuit 74 is coupled to summation circuit 76, where comfort noise 75 is optionally added to the signal. The signal is then converted back to analog form by D/A converter 77, amplified in amplifier 78, and coupled to line output 64. Circuit 73 reduces acoustic echo and circuit 81 reduces line echo as directed by control 80. The operation of these last two circuits is known per se in the art; e.g. as described in the above-identified text.

Figure 8:
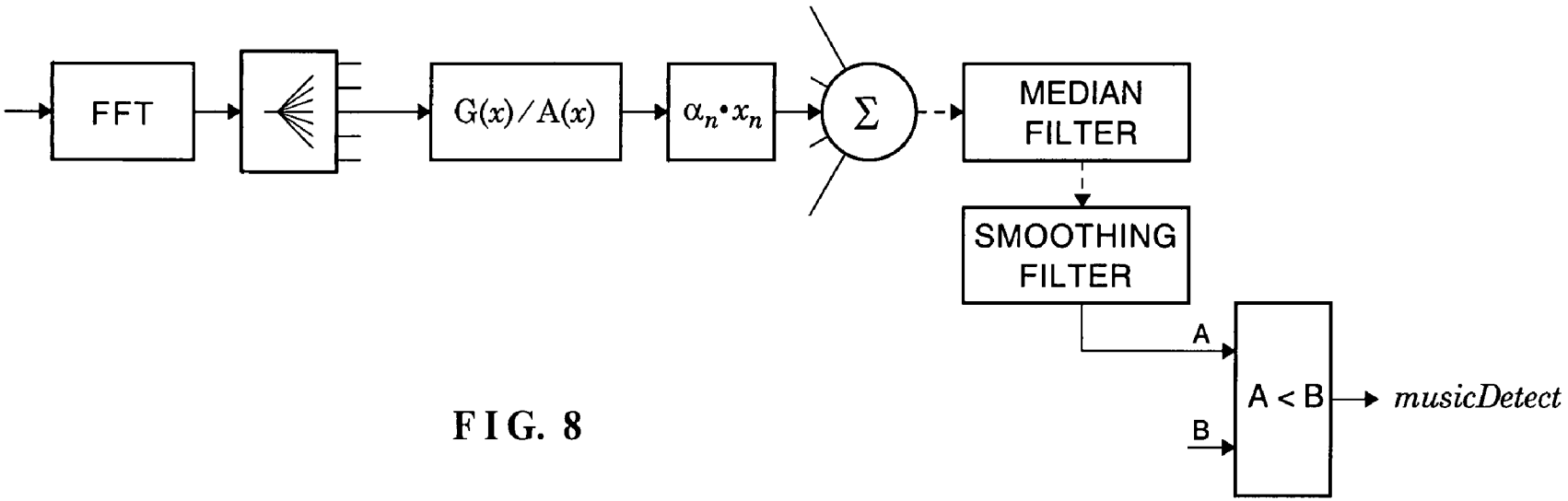
FIG. 8 is a block diagram of a music detector constructed according to a preferred embodiment of the invention.

FIG. 8 is a block diagram of a music detector for controlling at least a portion of the non-linear processor. The music detector is based upon a circuit that looks at the spectral amplitude (or energy) of samples of the signal and computes the ratio of the geometric mean to the arithmetic mean of the spectrum. A geometric mean is the $n^{th}$ root of the product of n samples. An arithmetic mean is the sum of n samples divided by n. As known in mathematics, this ratio is always less than one unless the data are equal. For example, $$\sqrt[4]{2\times2\times2\times2} = (2+2+2+2)/4$$

but $$\sqrt[4]{1\times2\times3\times4} < (1+2+3+4)/4.$$

Equality, or perfect smoothness, is unattainable so, in practice, the ratio is always less than one.

Because a geometric mean involves repeated multiplication, the precision of the root will be much less than the precision of the factors of the product if sixteen bit precision is used. On the other hand, increasing the number of bits of precision can significantly slow the calculation. This dilemma is solved according to another aspect of the invention by computing the geometric mean, arithmetic mean, and their ratio using floating-point notation (mantissa and exponent) in a 16-bit, fixed-point processor, referred to herein as a pseudo floating-point operation. The exponent is stored in a 16-bit memory location. The performance of the pseudo floating-point operation is equal to or better than conventional floating-point performance using processors of the same precision, e.g. 16-bits. Using the pseudo floating-point operation, the system is able to detect the presence of music correctly even if the signal level is very small (less than −45 dBFS). The steps in FIGS. 9, 10 and 11 illustrate the computation of SFM using exponent and mantissa format. The norm factor mentioned in FIG. 9 is the number of left shifts needed to scale a given number to the range [0.5, 1.0].

In general, in a musical piece, a singer is accompanied by musical instruments playing at different frequency ranges. Under these circumstances, a spectral flatness measure of the entire spectrum may not give a distinct, discriminating feature to distinguish the music from noise. In order to circumvent this problem, according to another aspect of the invention, the input signal is filtered to divide the signal into subband. The subbands are preferably octaval and are individually weighted to give more emphasis to lower frequencies.

The following table shows the octave spacing used in one embodiment of the invention. The first subband is a whole octave. The remaining subbands are split octave. The subband spacing was determined empirically by performing Monte-Carol simulation on a large database consisting of two hundred fifty-two music files and one hundred eighty-nine noise files. In the Table, L refers to the bin number corresponding the lower frequency boundary, H refers to the bin number corresponding to the higher frequency boundary and M is the number of spectral bins in each subband.

TABLE

| Subband No. (i) | Freq. (Hz.) | L | H | M | α |
|---|---|---|---|---|---|
| 1 | 500-1000 | 33 | 64 | 32 | 1.00 |
| 2 | 1000-1500 | 65 | 96 | 32 | 0.50 |
| 3 | 1500-2000 | 97 | 128 | 32 | 0.73 |
| 4 | 2000-2500 | 129 | 160 | 32 | 0.61 |
| 5 | 2500-3500 | 161 | 224 | 64 | 0.52 |

The spectral flatness measure (SFM) in each subband is calculated using the following formula.

$$SFM(n, i) = \frac{\sqrt[M(i)]{\prod_{k=L(i)}^{H(i)} X^2(k)}}{\frac{1}{M(i)}\sum_{k=L(i)}^{H(i)} X(k)}$$

SFM(i) spectral measure for i subband at time (n), L(i) and H(i) correspond to the lower and higher spectral bin number for $i^{th}$ subband and M(i) is the number of bins in $i^{th}$ subband.

One can distinguish music and speech from noise using any one of the many N-feature sat classification algorithms, such as k-nearest-neighbor classifier, on the data for subband SFM. However, a simpler classification scheme is used in the invention. According to another aspect of the invention, a single test statistic is derived from the individual subband SFM. The test statistic is derived from an exponentially weighted sum of subband SFMs, as shown in the following equation.

$$\beta(n) = \sum_{(i-1)}^{q} \alpha^{(i-1)} SFM(n, i)$$

α is the weighting factor, q is the number of subbands and SFM(i) is the SFM for $i^{th}$ subband. The weighting is chosen to emphasize low frequencies, i.e. the contribution of individual SFMs gradually decreases as frequency increases. This is because, music, speech, and the noise spectrum share similar spectral characteristics at high frequencies. A weighting factor less than one (<1) suffices. A table could be used instead of calculating the weighting factor.

The test statistic β is preferably median filtered to reduce spurious spikes in the SFM estimate. That is, $$\lambda(n)=\text{median}\{\beta(n),\beta(n-1), \ldots \beta(n-p)\}$$

where p is the size of the median filter. The test statistic is further smoothed by calculating a rolling average to reduce the variance of the statistic.

$$\gamma(n)=\epsilon\gamma(n-1)+(1-\epsilon)\lambda(n)$$

where ϵ is the smoothing constant, γ(n) is the smoothed test statistics at time (n) and γ(n−1) is the test statistic at time (n−1).

Finally, the smoothed test statistic is compared with a threshold to detect the presence of music. Specifically, if the smoothed test statistics are greater than the threshold η, then the spectrum is relatively flat and background noise is present and musicDetect goes to a logic "false" or, for positive logic, a "0" (zero). If the smoothed test statistic is not greater than the threshold η, then music is present and musicDetect is true or "1". The musicDetect signal is used by control 80 (FIG. 7) to prevent noise reduction circuitry in non-linear processor 74 from reducing noise when music is present.

The invention thus provides a method for unambiguously distinguishing mainstream music genre from noise. The method does so efficiently, requiring little computational power, in part, due to the use of a pseudo floating-point operation in a fixed-point processor, and does so in real time.

Having thus described the invention, it will be apparent to those of skill in the art that various modifications can be made within the scope of the invention. For example, circuits 72 and 76 (FIG. 7) are called "summation" circuits with the understanding that a simple arithmetic process is being carried out, which can be either digital or analog, whether the process entails subtracting one signal from another signal or inverting (changing the sign of one signal and then adding it to another signal. Stated another way, "summation" is defined herein as generic to addition and subtraction. Rather than dividing the spectrum into subbands and individually weighting the subbands, one could simply filter and analyze the lower portion of the spectrum, e.g. 300-1200 Hz. Rather than dividing the spectrum into octaval subbands, one could use exponentially related subbands. That is, the subbands can be related by other than a power of two; e.g. 1.5, 2.5, or 3. The system is not reliable using Bark bands (center frequencies of 570, 700, 840, 1000, 1170, 1370, 1600, 1850, 2150, 2500, 2900, 3400 Hz). The range covered is less than the frequency response of a telephone, roughly 50-3000 Hz. In systems having wider frequency response, a different set of octaves can be used. Rather than completely preventing noise reduction, a high on musicDetect could be used to reduce the effect of noise reduction circuitry, rather than shutting it off.

What is claimed as the invention is:

1. A method comprising the steps of:

digitizing an analog signal by converting said analog signal into a plurality of samples indicating the magnitude of the analog signal at the time of the sample;

dividing the signal into exponentially related subband signals;

determining the spectral flatness measure of each subband signal;

wherein the spectral flatness measure is the ratio of the geometric mean of a group of samples to the arithmetic mean of the same group of samples;

combining the spectral flatness measures; and comparing the combined spectral flatness measures with a threshold.

2. The method as set forth in claim 1 wherein said dividing step divides the signal into octavally related subband signals.

3. The method as set forth in claim 1 wherein said comparing step is followed by the step of indicating whether or not the analog signal contains music depending upon the outcome of said comparing step.

4. The method as set forth in claim 1 wherein said determining step is performed using pseudo floating-point operations in a fixed-point processor.

5. In a telephone including an audio frequency circuit having a first channel, a second channel, and a noise reduction circuit in one of said first channel and said second channel, the improvement comprising:

a detector in said audio frequency circuit for sensing components in an audio signal and controlling said noise reduction circuit to prevent distortion to the audio signal;

said detector including:

band pass filters for dividing said audio signal into exponentially related bands;

a fixed-point calculator for determining spectral flatness in each band using pseudo floating-point operations and producing a plurality of outputs;

wherein spectral flatness is the ratio of the geometric mean of a group of samples to the arithmetic mean of the same group of samples;

a summation circuit for combining said plurality of outputs into a flatness output signal; and a circuit for controlling said noise reduction circuit depending upon said flatness output signal.

6. The telephone as set forth in claim 5 and further including a circuit for averaging successive flatness output signals and for coupling the average to said circuit for comparing.

7. In a telephone including an audio frequency circuit having a first channel, a second channel, and at least one echo canceling circuit coupled between said first channel and said second channel, the improvement comprising:

a detector in said audio frequency circuit for sensing components in an audio signal and controlling said echo canceling circuit to prevent unwanted sounds;

said detector including:

band pass filters for dividing said audio signal into exponentially related bands;

a fixed-point calculator for determining spectral flatness in each band using pseudo floating-point operations and producing a plurality of outputs;

wherein spectral flatness is the ratio of the geometric mean of a group of samples to the arithmetic mean of the same group of samples;

a summation circuit for combining said plurality of outputs into a flatness output signal; and a circuit for controlling said echo canceling circuit depending upon said flatness output signal.

8. The telephone as set forth in claim 7 and further including a circuit for averaging successive flatness output signals and for coupling the average to said circuit for comparing.

* * * * *